United States Patent [19]

Roger

[11] Patent Number: 4,957,241

[45] Date of Patent: Sep. 18, 1990

[54] FUEL INJECTION DEVICE WITH AIR CHAMBER

[75] Inventor: Laboueffe Roger, Rueil Malmaison, France

[73] Assignee: Solex, France

[21] Appl. No.: 400,540

[22] Filed: Aug. 30, 1989

[30] Foreign Application Priority Data

Aug. 30, 1988 [FR] France ..... 88 11376

[51] Int. Cl.[5] ..... F02M 61/16; F02B 51/06

[52] U.S. Cl. ..... 239/409; 239/132.5; 239/585

[58] Field of Search ..... 239/132, 132.1, 132.3, 239/132.5, 407, 408, 409, 432, 585

[56] References Cited

U.S. PATENT DOCUMENTS

| | | | |
|---|---|---|---|
| 4,006,719 | 2/1977 | Kanda et al. | 239/405 |
| 4,216,753 | 8/1980 | Inoue et al. | 239/405 |
| 4,280,661 | 7/1981 | Tanasawa et al. | 239/409 |
| 4,434,766 | 3/1984 | Matsuoka et al. | 239/405 |
| 4,836,453 | 6/1989 | Poehlman | 239/408 |

*Primary Examiner*—Andres Kashnikow
*Assistant Examiner*—Karen B. Merritt
*Attorney, Agent, or Firm*—Larson and Taylor

[57] ABSTRACT

A fuel injection device for an internal combustion engine comprises an electrically controlled injector having a body removably connected in a passage opening into an engine induction passage. The body has a nose of reduced diameter. A cap is fitted on the nose of the injector and formed with a fuel jet outlet opening. The cap and nose of the injector define an air chamber. Lateral openings of the cap communicate the air chamber with a space formed between the cap and the wall of the passage, connected to an air source. A spacer plate is retained between the cap and the nose and formed with a central calibrated hole surrounding an outlet of the injector for constituting a calibrated fuel and air jet outlet passage. The spacer plate is retained between the nose and the cap in a predetermined position.

4 Claims, 2 Drawing Sheets

FUEL INJECTION DEVICE WITH AIR CHAMBER

BACKGROUND OF THE INVENTION

1. Field of the Invention

The invention relates to fuel injection devices for internal combustion engines; it is particularly suitable for use in so-called "multipoint" injection systems, in which each combustion chamber of the engine is provided with an injection device which has its outlet in the vicinity of a respective inlet valve.

In such a system, the nose of the injector is placed close to the combustion chamber of the engine which tends to heat it to a high temperature, which results in the nose being clogged up by the products or additives contained in the fuel delivered by the injector.

2. Prior Art

An injection device disclosed in U.S. Pat. No. 4,434,766 (Matsuoka et al) comprises an electrically controlled injector having a body provided with means for removably connecting said body in a passage opening into an engine induction passage and formed with a nose of reduced diameter and a cap fitted on the nose of the injector, formed with a fuel jet outlet opening, said cap being connected on the nose of the injector in such a position that it defines an air chamber with said nose and is formed with lateral openings communicating the air chamber with a space formed between the cap and the wall of said passage, said space being for connection to an air source.

As described, the outlet of the passage in the injector nose is connected to an air source.

It is further known to compensate for the direct air supply through a passage in an injector by giving to the minimum opening of the air intake butterfly valve a value which is slightly less than that which would be adopted in the absence of air delivery to the injectors.

A drawback of the arrangement described in U.S. No. 4,434,766 is that it does not accurately and reproducibly define the size of the air chamber, unless expensive machining methods are used.

SUMMARY OF THE INVENTION

It is an object of the invention to provide an injection device with a heat protection cap, of the above-defined kind, having fuel spraying characteristics which are improved under idling and low load conditions of the engine, due to an appropriate air supply, and whose air chamber has well-defined dimensions, while using only very simple means.

To this end, there is provided a device wherein said injection device further comprises a spacer plate retained between the cap and the nose, formed with a central calibrated hole surrounding an outlet of the injector for constituting a calibrated fuel and air jet outlet passage and wherein said spacer plate is provided with means for retaining it between the nose and the cap in a predetermined position. The spacer plate may typically have a flange bearing on the cap and bosses evenly spaced apart about the central hole and bearing on the nose of the injector.

The cap may have an opening significantly greater than that of a normal heat protection cap; then the central hole of the plate has a diameter just sufficient to let the fuel jet delivered by the injector pass to the inlet valve.

The cap may be simply a molded part of a heat-insulating plastic material and the spacer may be simply a shaped part of sheet metal.

The invention will be better understood from the following description of a particular embodiment, given by way of non-limitative example. The description refers to the accompanying drawings.

DETAILED DESCRIPTION OF PREFERRED EMBODIMENTS

Figure 1:
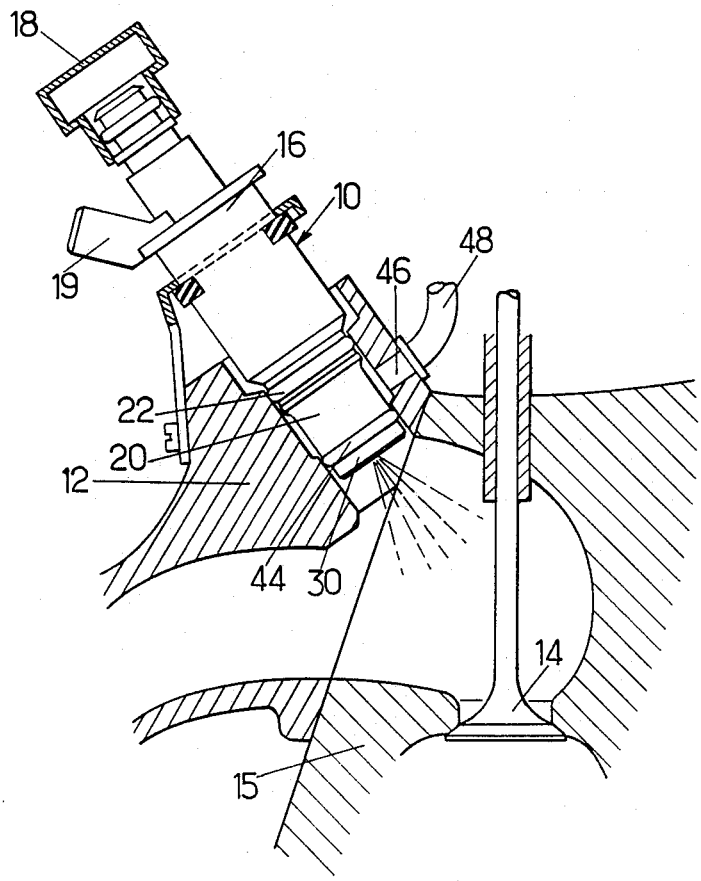
FIG. 1 shows schematically an arrangement of an injection device on an engine intake pipe.

Referring to FIG. 1, an injection device 10 is mechanically connected to the inlet pipe 12 of an engine so as to deliver a fuel jet towards an inlet valve 14.

The injection device is placed in a passage formed in pipe 12 and opening into the cylinder head. It may be considered as comprising a rear body 16, connected to a fuel intake pipe 18 and to an electrical connector 19, and a nose 20 of reduced diameter. An O-ring 22 carried by nose 20 of the injector bears against the wall of the passage formed in pipe 12 and sealingly separates said pipe from the ambient atmosphere. Within the nose, there is formed a fuel jet channel 24, which can be closed by a needle valve 26 whose movements are controlled by an electromagnetic coil housed in the body (not shown). In the embodiment illustrated, the needle valve is extended by a nipple 28 having a diameter less than that of channel 24 and projecting therefrom, so that the fuel is sprayed into the passage defined by channel 24 and nipple 28.

A cap 30, generally made of an insulating plastic material, is fitted on nose 20 of the injector. An internal circumferential rib 32 of the cap is provided for snapping into a groove 34 of the nose of the injector and for locking the cap in a position such that there exists an air chamber 38 between the nose and the bottom wall of the cap. The cap is formed with a central opening 36 having a diameter sufficient for free egress of the fuel jet delivered by the injector.

Chamber 38 is fed with air originating for example from the air supply intake of the engine. For that, lateral holes 40 in the cap, four in number in the embodiment shown in FIGS. 2 and 3, communicate the air chamber 38 with an annular space 42 defined in the pipe by the cap 30, the O-ring 22 and a second O-ring 44 emprisoned in a groove formed in the cap. The annular space communicates with the air intake of the engine through a channel 46 formed across the pipe wall and a conduit 48 (FIG. 1).

Figure 2:
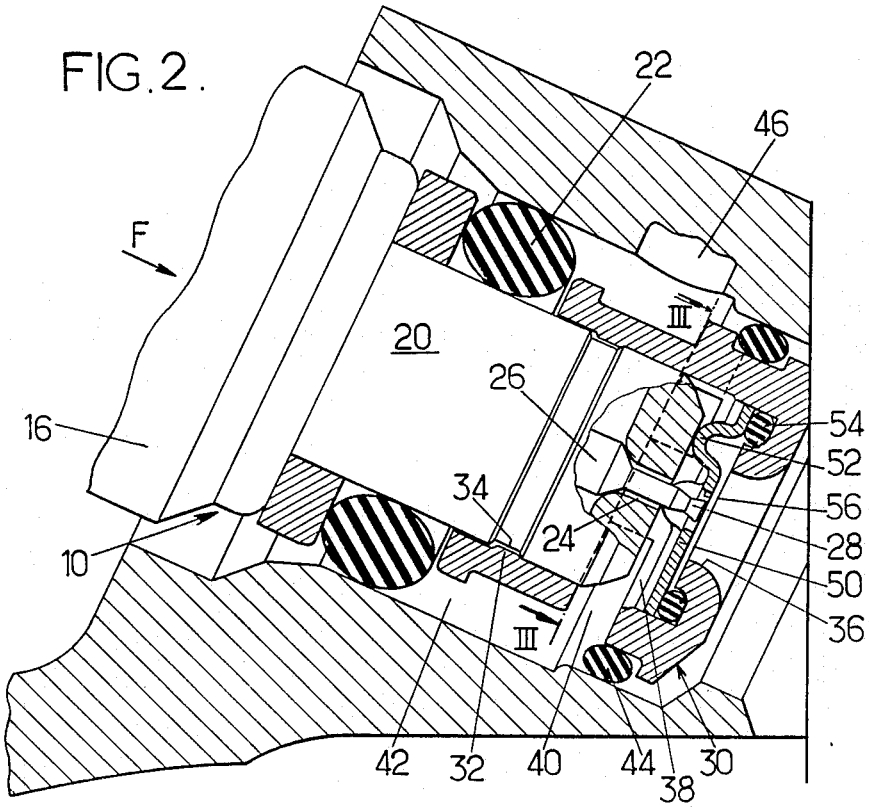
FIG. 2 shows the front part of the injection device of FIG. 1, in cross-section through plane II—II of FIG. 3.
Figure 3:
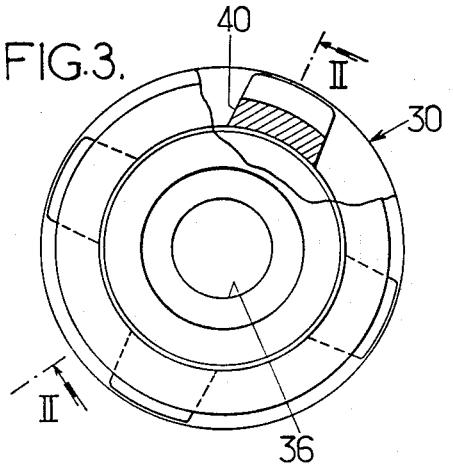
FIG. 3 shows the cap of the device of FIG. 2, as seen in the direction of arrow F and in partial cross-section taken along the plane III—III of FIG. 2.
Figure 4:
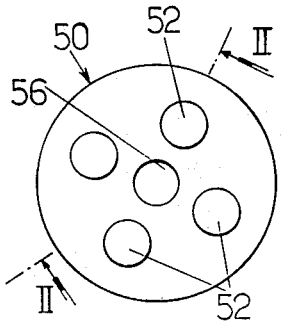
FIG. 4 shows the spacer plate of the device of FIG. 2, as seen in the direction of arrow F.

In the embodiment of the invention shown in FIGS. 2 to 4, a spacer plate 50 is disposed between the bottom of cap 30 and nose 20 of the injector. The plate makes it possible to accurately meter the spacing between the bottom of the cap and the nose. For that, it comprises a plurality of bosses 52, four in number as shown in FIGS. 2–4, bearing against the nose and a peripheral portion arranged to bear on the bottom of the cap through an O-ring 54. The O-ring seals off the connection between the spacer plate and the cap. In addition, its elasticity holds the bosses 52 applied against nose 20. Plate 50 is formed with a central calibrated hole 56 surrounding the end of the nipple with which it forms a calibrated outer passage for the fuel and air jet coming from the chamber. It can be seen in FIG. 2 that this arrangement renders it possible to form an opening 36 of larger diameter, so as not to disturb spraying of the fuel fed to the engine.

During operation of the engine supplied by the injector, assist air is sucked through channel 46, the annular space 42, holes 40 and the air chamber 38. That air mixes with the fuel and atomization remains satisfactory on idling and when the engine is under low load. In addition, cooling by the fresh air stream which sweeps the nose of the injector has an effect which is aided by the heat insulation provided by cap 30 and the spacer plate 50 and reduces heating and clogging up of the injector.

I claim:

1. Injection device for an internal combustion engine, comprising an electrically controlled injector having a body provided with means for removably connecting said body in a passage opening into an engine induction passage and formed with a nose of reduced diameter and a cap fitted on the nose of the injector, formed with a fuel jet outlet opening, said cap being connected on the nose of the injector in such a position that it defines an air chamber with said nose and is formed with lateral openings communicating the air chamber with a space formed between the cap and the wall of said passage, said space being for connection to an air source, wherein said injection device further comprises a spacer plate retained between the cap and the nose, formed with a central calibrated hole surrounding an outlet of the injector for constituting a calibrated fuel-air jet outlet passage and wherein said spacer plate is provided with means for retaining it between the nose and the cap in a predetermined position.

2. Device according to claim 1, wherein said spacer plate has a peripheral portion arranged for bearing on a bottom wall of the cap through an O-ring seal and a plurality of bosses arranged for bearing on the nose of the injector, which determines the distance between the bottom wall of the cap and the nose.

3. Device according to claim 1, wherein said space is annular in shape and is defined by the cap, the wall of the passage and O-ring seals bearing on the wall and respectively carried by the nose and the cap.

4. Device according to claim 1, wherein said cap has a radially inwardly directed circumferential rib arranged to snap into a peripheral groove of the nose.

* * * * *